United States Patent [19]

Fulton, Jr.

[11] 4,259,799

[45] Apr. 7, 1981

[54] COMBINATION PACKAGE COMPRISING A LOOSE LEAF BOOK, A PLURALITY OF TRANSPARENT PLASTIC FRAMES, AND MEANS FOR HANGING THE SAME

[76] Inventor: Robert E. Fulton, Jr., Newtown, Conn. 06470

[21] Appl. No.: 39,336

[22] Filed: May 16, 1979

[51] Int. Cl.[3] ..... G09F 1/12

[52] U.S. Cl. ..... 40/159; 11/1 R

[58] Field of Search ..... 40/159, 405, 537, 10 D, 40/124.2, 359, 152.1, 158 B, 152; 281/45, 31; 11/1 R, 1 AC

[56] References Cited

U.S. PATENT DOCUMENTS

| | | | |
|---|---|---|---|
| 1,080,219 | 12/1913 | Housh | 40/159 |
| 3,091,046 | 5/1963 | Engelstein et al. | 40/159 X |
| 3,350,045 | 10/1967 | Mayers | 248/206 A |
| 3,727,256 | 4/1973 | Gill | 11/1 R |
| 3,881,203 | 5/1975 | Giulie | 11/1 AC |
| 4,172,332 | 10/1979 | Holes et al. | 40/159 |
| 4,185,406 | 1/1980 | Schotsman | 40/158 B X |

*Primary Examiner*—Hugh R. Chamblee
*Attorney, Agent, or Firm*—Charles R. Fay

[57] ABSTRACT

An all-inclusive package comprising a book having an easily removable binding and cover, and removable leaves; in combination with a plurality of transparent plastic frames into which individual leaves from the book may be placed temporarily or permanently, means for hanging the frames for display, and means for holding the book, the frames and the hanging means together as a unit.

17 Claims, 12 Drawing Figures

FIG. 7
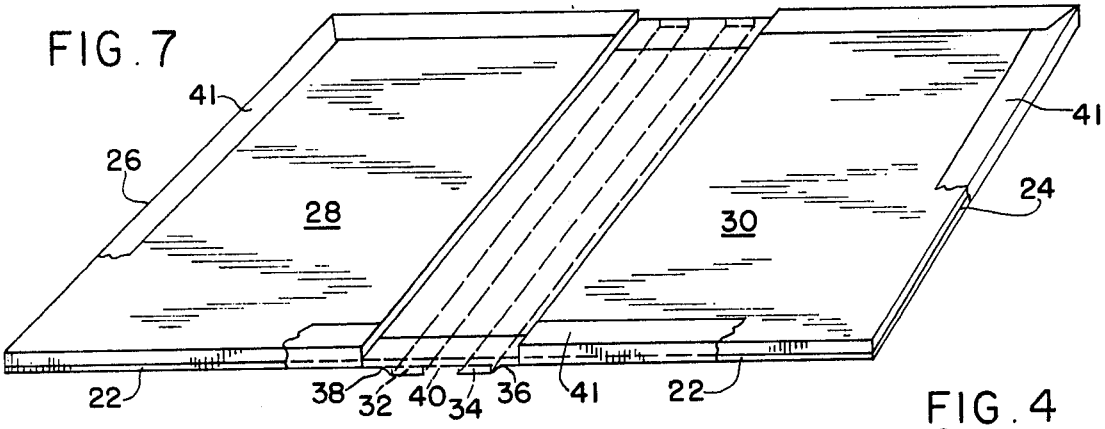
FIG. 4
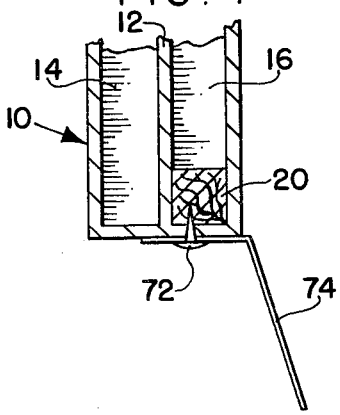
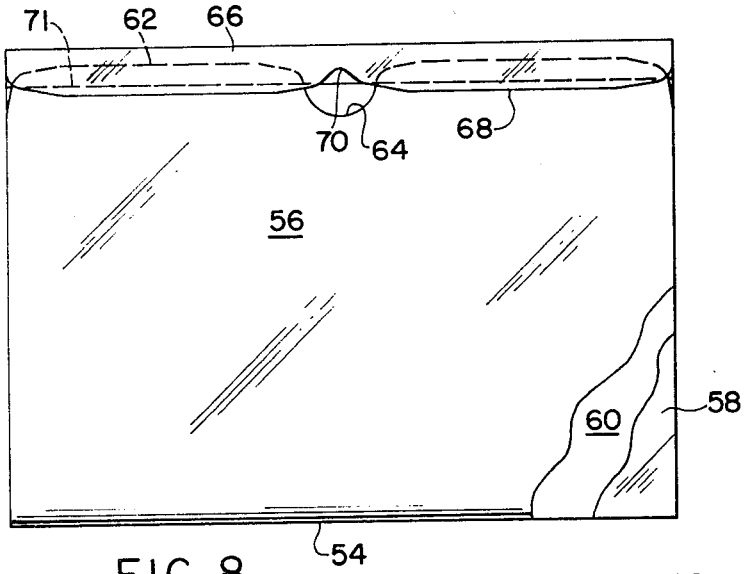
FIG. 8
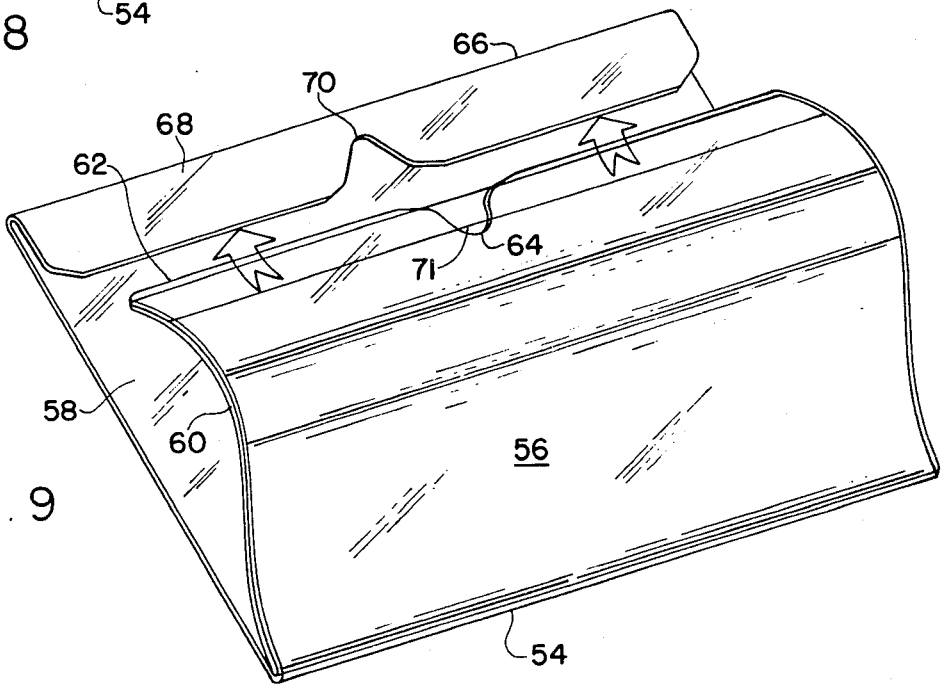
FIG. 9

COMBINATION PACKAGE COMPRISING A LOOSE LEAF BOOK, A PLURALITY OF TRANSPARENT PLASTIC FRAMES, AND MEANS FOR HANGING THE SAME

BACKGROUND OF THE INVENTION

For a great many years books have been bound in a substantially permanent condition so that any part of the book, if removed, will normally destroy or seriously damage the book. Loose leaf books which commonly have leaves with holes for the reception of holding rings are ungainly and easily torn. These are problems particularly with books containing pictures. Pictures are made to be seen but when bound in a book are virtually buried in a bookcase.

It is not practical to hang books on the wall nor is it desirable to cut them apart for that purpose, and even when cut apart they still require a practical method of protecting and hanging them.

The present invention provides an all-inclusive package by which pictures for instance may be transported or stored as desired in the nature of a book, and it also provides that the pictures may be extracted easily and selectively without damage to themselves or the book, together with means for framing each picture and means for hanging such frames for display.

SUMMARY OF THE INVENTION

This invention provides a container of suitable kind but preferably in the nature of an open-edge box of cardboard or the like having a longitudinal partition therein with a book of separate leaves firmly held together within a cover at one side of the partition, and a series of transparent plastic picture frames conveniently held at the other side of the partition. For reasons to be made more clear hereinafter, the compartment containing the plastic frames is made slightly shallower than the compartment containing the book. Both frames and book are easily extracted from the container; one or more pictures are easily extracted from the book, and these pictures are easily mounted in the plastic protective frames which are adapted to be mounted on a wall, e.g. by thumb tacks, or a special type of tape hanger, provided as a part of the package and having a unique manner of mounting and concealment at the exterior of the package.

It will be seen by this invention that one may arrange such pictures as he wants, where he wants them, and may change the same whenever desired and it is pointed out that all the elements of the invention going to obtain these desirable results are provided in a single unit.

The individual leaves or pictures are held in the book cover and are bound together by a removable channel clamp slidably arranged along the book backbone, the clamp being easily removable and as easily applicable, and there is a special new and improved construction between the removable channel clamp and the construction of the spine or backbone of the book as will be explained more fully hereinafter.

BRIEF DESCRIPTION OF THE FIGURES

FIG. 4 is a sectional view on line 4—4 of FIG. 2;

FIG. 7 is a perspective view illustrating the book cover in flat condition;

FIG. 8 is a rear view of one of the picture frames;

FIG. 9 is a perspective view illustrating the operation of a plastic picture frame;

PREFERRED EMBODIMENT OF THE INVENTION

Figure 1:
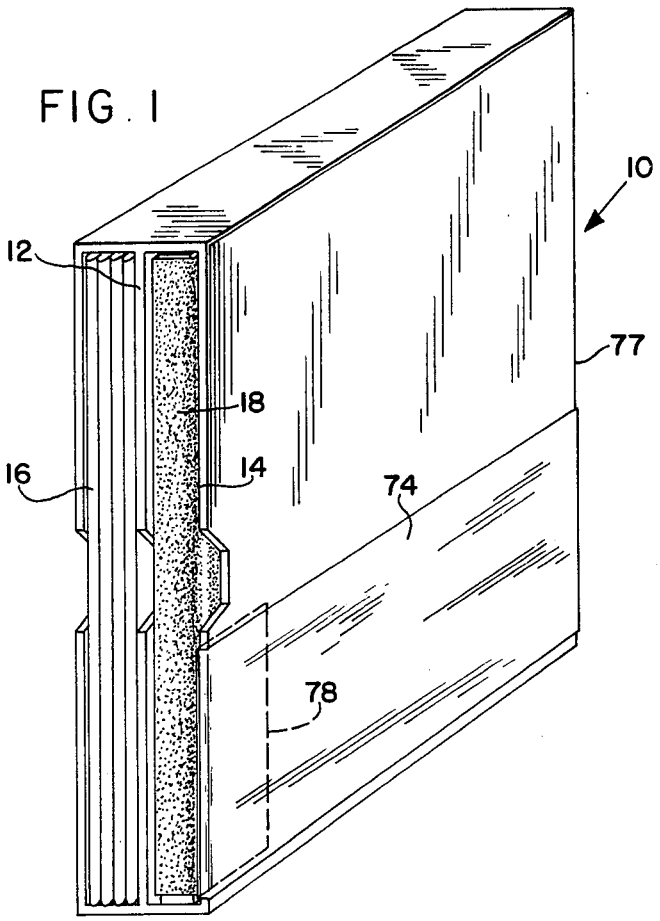
FIG. 1 is a perspective view illustrating the invention.
Figure 2:
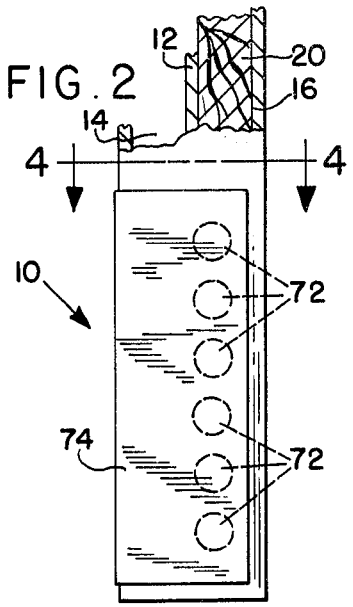
FIG. 2 is a detailed view partly in section showing a portion of the rear part of the box or book jacket shown in FIG. 1.

The reference numeral 10 indicates generally an open-sided box, book jacket, or the like. It has a longitudinal generally central partition 12 dividing the same into two compartments 14 and 16. Compartment 16 contains frames for holding pictures individually for hanging on the wall or the like, these frames being described in more detail hereinafter; and compartment 14 holds the book 18 which contains removable pictures. At the bottom of compartment 16 there is inserted a strip of wood or similar material 20, also shown in FIG. 4, because this compartment must be shorter or shallower than the compartment 14 since the book itself has an overall width greater than that of the individual frames. The frames fit into compartment 16 resting on the block 20 which makes the edges of the frames, visible in FIG. 1, level with the back or spine of the book. Looking at FIG. 1, the spine of the book is exposed but the book and frames fit neatly and evenly in the box or book jacket 10.

FIG. 7 shows the book cover which comprises a foldable sheet 22 of suitable material which extends from edge 24 to edge 26 thereof. Applied in spaced relation on and to either side of the central portion of sheet 22 are identical strengthening cardboards 28 and 30. These are positioned as shown in FIG. 7 but they are connected by sheet 22. Two narrow filler strips of strengthening material which are indicated as 32 and 34 are applied to sheet 22 at its under side or outside in parallelism with cards 28 and 30 and they are spaced from each other and from the said cards leaving spaces 36 and 38 adjacent to the cards 28 and 30, and a central space 40 between the strips 32 and 34. An ornamental cover paper or the like 41 may be adhered to the sheet 22 and strips 32,34.

Figure 5:
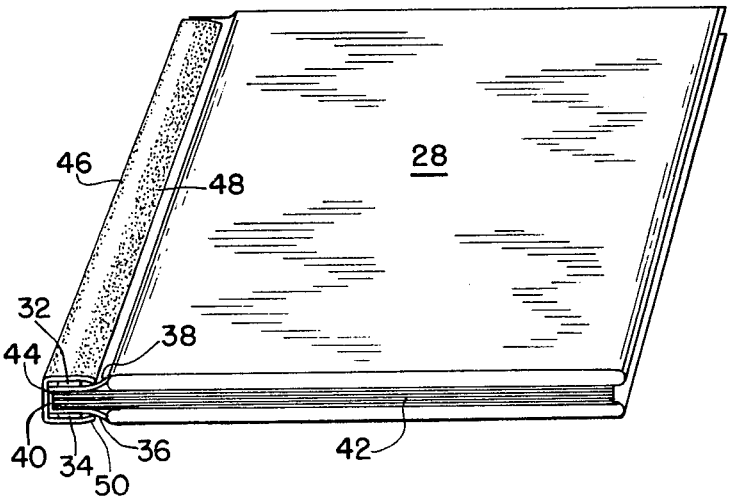
FIG. 5 is a perspective view illustrating the complete book consisting of cover, binder and individual pages.
Figure 6:
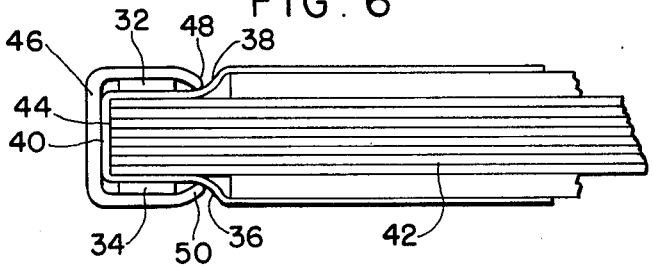
FIG. 6 is an enlarged detail of the spine of the book.

When the two leaves of the book cover are folded over upon each other with multiple pages or pictures 42 as shown in FIGS. 5 and 6, therebetween, the ends thereof as at 44 are located in general abutting relation with respect to the portion 40, and the two filler strips 32 and 34 overlie these edge portions of the pages or pictures 42 leaving the areas 36, 38 free.

There is provided a channel shaped clamp member generally indicated at 46 and this is a slidable device with inturned free edges 48,50 along the open edge of the channel. These are dimensioned to closely engage the portions 36 and 38 of the cover in such a way as to closely clamp the pages or pictures etc. 42, and they indent the areas 36,38 which are defined by the filler strips 32,34 and the adjacent edges of the reinforcing cards or sheets 28 and 30. It is only necessary to slide the channel shaped member 46 into place to grip all the pages inside the book cover; or conversely, to remove the channel strip 46 by sliding it off, whereupon any of the pictures or pages which, of course, are otherwise completely free may be selected for application to the frames which are shown in FIGS. 8 and 9.

Referring now to FIGS. 8 and 9 there is shown a frame several of which are included in the package as shown in compartment 16 of FIG. 1. These frames each comprises a single piece of clear plastic which is folded as at 54 forming the two leaves 56 and 58, and there may be a stiffening card 60 contained in the pocket formed thereby. One edge as at 62 is indented as at 64 to provide clearance for the head of a thumbtack as will be hereinafter explained, and the other edge as at 66 is folded over to form the flap 68. The indentation 70 is for the purpose of hanging the frame with the picture in it, FIG. 8 showing the rear aspect of the frame, the front portion of which is simply plain.

To insert a picture to be displayed in this frame, the selected picture is placed face down on a flat surface and the frame card 60 is placed on top aligning the bottom and the sides and folding over a flap at 71. Then the frame is opened, see FIG. 9, and the picture and card are collectivly slipped under the flap 68, with the edge 62 leading.

The framed picture may now be hung on the head of a thumbtack protruding from a wall or the like as will be clear to those skilled in the art, the head of the tack being received in the clearance space 64 and the notch 70.

Figure 3:
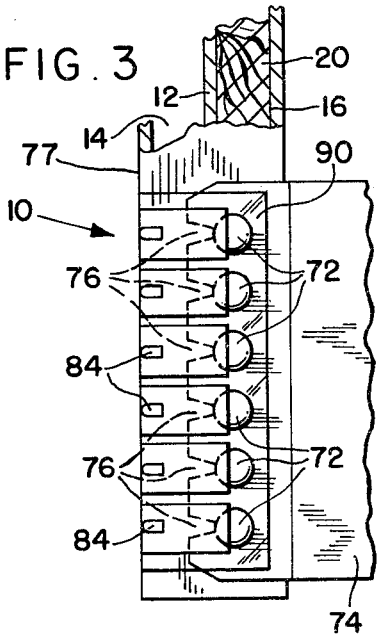
FIG. 3 is a view similar to FIG. 2 but showing the tacks in exposed condition.

The thumb tacks are provided with this package and they are shown at 72, see FIG. 3. They penetrate the wooden strip 20 as shown in FIG. 4 and are thus held in position at the outside of the rear edge of the book jacket 10.

Since it is often considered undesirable to make holes in a wall (such as with plaster) or is sometimes impractical (such as with steel office partitions), an alternate method of hanging is provided. Individual stick-on tapes appropriately called "tape-tacks" adhere to the wall or other display mount by virtue of a permanent adhesive tape which supports a hook which in turn performs the same function as the head of a thumbtack.

Figure 10:
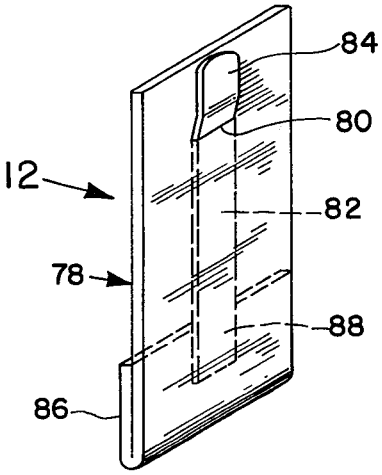
FIG. 10 is a perspective view illustrating an alternative picture frame hanger.

FIG. 10 illustrates the tape-tack assembly. Each individual tape is indicated at 78, and comprises a preferably fabric sheet coated with a permanent adhesive. A narrow slot 80 is cut through the tape near the top end and a preformed strip 82, preferably metal, is passed through said slot in such a way that the flat length of the strip interfaces with the adhesive on the back of the fabric sheet while a preformed hook 84 stands away from the fabric on the other non-adhesive side and extends upwardly approximately to the top of the sheet. The lower end of the fabric sheet is then doubled back on itself, adhesive to adhesive, to form a tab 86. This tab is of such a length that it encloses the bottom of the metal strip at 88 for reasons to be explained.

Each tape when applied to a wall or other surface where it is desired to hang a frame now serves the same purpose as a thumbtack but does not penetrate the wall. As with the thumbtack, the hook 84 engages in the slot 70 (FIG. 9) in the back of the frame.

Figure 11:
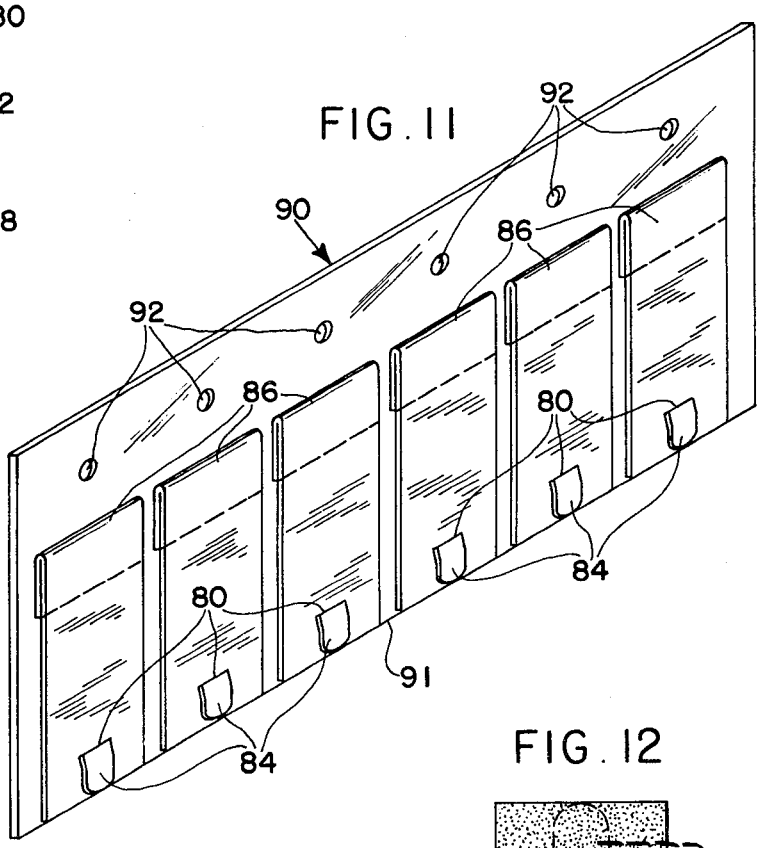
FIG. 11 is a perspective view illustrating a way of mounting these hangers for integration into the complete package.
Figure 12:
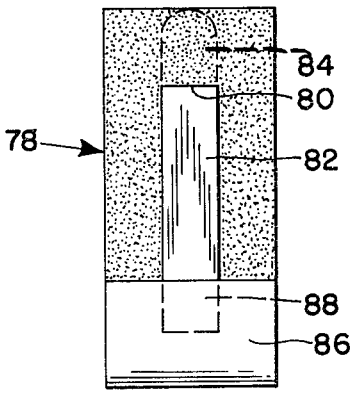
FIG. 12 is a view looking in the direction of arrow 12, FIG. 10.

Since the adhesive has considerable tenacity it cannot be put in direct contact with the paper cover of the box. A plastic sheet 90, FIG. 11 is therefore provided and all the tapes are adhered to it, their hook ends being made flush with one edge 91. The sheet must be strong enough not to tear when the tape-tacks are being removed.

To remove any one of the tape-tacks from base 90 it is only necessary to pull on convenient tab 86, which is non-adhesive, and peel the tape off. If the end 88 of the metal strip 82, FIG. 10, were not caught in the tab 86, the adhesive coated fabric tape would be apt to peel away from the metal strip 82 at the same time that it peeled off the plastic base and the whole tack-tape assembly would be rendered useless.

Mounting sheet 90, FIG. 11, is also perforated with holes 92 which correspond in number and location with thumbtacks 72 which are used to retain the tack-tape assembly on box 10. In turn a strip of paper or the like 74 may be used to cover the collective assembly of thumbtacks and tack-tapes. Provided with slots corresponding to the number and location of tacks, the cover 74 may be inserted between box 10 and the tape-tack mount and then be folded back on top of itself around the rear edge 77 of the book jacket to the open end thereof where it is preferably provided with a flap 78 bending around the edge of the pocket 18 as shown in FIG. 1. Paper 74 may be used for instructions, etc.

The pictures not being used are replaced in the book cover 28 of FIG. 5 and reclamped with channel clamp 46 which does not penetrate or deface the pages in any way.

The different pages held in the book are all the same size, separate and numbered. Any one or more can be removed or replaced without harming the others. These sheets slide easily into the simple frames which are a basic part of the package which is brought together by the structure of the box or jacket 10 which protects the book and provides a pocket for the frames and a storage location for their hanging devices.

This invention is useful not only in the world of art books where a book of types, or of artists, can be formulated, or even a book of many pictures of a single artist, but it is also useful for childrens books, poetry, philosophical works, instruction books and manuals, and any other type of publication where it would be advantageous to excerpt, exhibit, exchange and replace various parts of the work without difficulty or damage. The pages, pictures, charts in the book may be selected and changed at any time it is desired to do so. The contents of the book are no longer rigidly confined within the book covers but are now available with ease and no damage for display by means readily at hand by virtue of the design of the package as a whole.

I claim:

1. A package comprising a book containing a plurality of loose leaves, said book having cover means, means clamping the cover means with the loose leaves retained between the book covers, said clamp being inherently resilient and holding the book covers and leaves solely by the resilience thereof, a set of frames for said leaves, each frame being of transparent plastic and adapted to enclose a selected leaf for mounted display, means adapted to engage the frames for hanging the frames and a selected leaf for display, and a common means for separately, removably containing and storing the book, the frames, and the means for hanging them.

2. The package of claim 1 wherein the common means for containing the book and frames and hanging means comprises a book jacket.

3. The package of claim 2 wherein said book jacket comprises an open-sided box.

4. The package of claim 3 including a partition in said box extending from end to end thereof, and dividing the same into two pockets, the book being located in one pocket and the frames in the other pocket.

5. The package of claim 4 including means securing the hanging means with respect to said box.

6. The package of claim 3 wherein the hanging means comprises tacks removably secured to the box.

7. The package of claim 3 wherein the hanging means comprises self-adhesive tapes, and a hook on each tape.

8. The package of claim 7 wherein each hook includes a shank adherent to the respective tape.

9. The package of claim 8 wherein the hook appears at one side of the tape that is non-adherent.

10. The package of claim 9 wherein the hook is one end of its respective tape and the opposite end of the tape is non-adherent.

11. The package of claim 9 including a plastic strip to which the tapes adhere, and tacks holding the strip to the box.

12. The package of claim 5 including means for concealing said frame hanging means and including a foldable element overlying the same, said element extending to the open edge of the book jacket and having a flap extending into the book jacket.

13. The package of claim 1 wherein each frame includes a clear plastic sheet folded to form a pocket, a lip on one edge thereof, the opposite edge extending under and being held by said lip, and a card in said frame.

14. The package of claim 3 including a filler at the bottom of the pocket containing the frames, the book being wider than the frames.

15. The package of claim 14 including tacks inserted through the book jacket into the said filler.

16. A package comprising a box, said box being closed except for an open edge, a partition in said box extending parallel to the sides thereof and being spaced therefrom forming two pockets, a book in one pocket, a set of light clear plastic picture frames in the other pocket, said book including a plurality of sheets of similar size, said sheets having indicia thereon, slidable channel shaped clamp for the spine of the book, the sheets extending into the spine and the clamp, the sheets being otherwise free of the clamp and the clamp having no damaging effect on said pages when the same are clamped, the sheets being slightly larger than the frames but being mountable therein, wherein said book comprises a sheet, a pair of spaced reinforcing members on said sheet, said reinforcing members being spaced at the center of the sheet, a channel shaped clamping strip, a pair of filler strips extending the length of the space between the reinforcing members, said filler strips being spaced both from each other and from the adjacent edges of the reinforcing members, said filler strips forming a reception element for the clamping strip, and the spaces between the filler strips and adjacent edges of the reinforcing members forming longitudinal indentations, said slidable channel clamping strip having a longitudinal edge slightly bent inwardly to grip the spine and the pages in the area of said indentations.

17. A book comprising a plurality of sheets, a covering sheet encasing the plurality of loose sheets, a pair of reinforcing members spaced adjacent the center of the covering sheet and secured therewith, a slidable channel shaped clamping strip, a pair of spaced filler strips extending partially the length of the space between the reinforcing members and secured with said covering sheet, said filler strips being spaced both from each other and from the adjacent edges of the reinforcing members, said filler strips forming a reception element for the clamping strip, and the spaces between the filler strips and adjacent edges of the reinforcing members forming longitudinal indentations, said slidable channel clamping strip having longitudinal edges slightly bent inwardly to grip the covering sheet in the area of said indentations to retain the loose sheets between the covering sheet.

* * * * *